US009372438B2

(12) United States Patent
Tetu et al.

(10) Patent No.: US 9,372,438 B2
(45) Date of Patent: Jun. 21, 2016

(54) SYSTEM AND METHOD FOR DETERMINING A LEVEL OF TONER IN A REPLACEMENT TONER CARTRIDGE

(71) Applicant: eCommerce Industries, Inc., Leesburg, VA (US)

(72) Inventors: Kevin Tetu, Mesa, AZ (US); David R. Webb, Landera Ranch, CA (US)

(73) Assignee: ECI Software Solutions, Inc., Fort Worth, TX (US)

( * ) Notice: Subject to any disclaimer, the term of this patent is extended or adjusted under 35 U.S.C. 154(b) by 0 days.

(21) Appl. No.: 14/516,652

(22) Filed: Oct. 17, 2014

(65) Prior Publication Data

US 2016/0109825 A1 Apr. 21, 2016

(51) Int. Cl.
*G03G 15/08* (2006.01)
*G03G 15/00* (2006.01)

(52) U.S. Cl.
CPC ..... *G03G 15/0831* (2013.01); *G03G 15/556* (2013.01); *G03G 15/0856* (2013.01); *G03G 15/0863* (2013.01); *G03G 15/553* (2013.01)

(58) Field of Classification Search
CPC ..... G03G 15/0831
See application file for complete search history.

(56) References Cited

U.S. PATENT DOCUMENTS 6,456,802 B1 9/2002 Phillips
6,510,292 B1 * 1/2003 Owen ..... B41J 2/17546 399/27
7,986,888 B2 7/2011 Hibino
8,611,766 B2 12/2013 Kawai
2004/0120725 A1 * 6/2004 Wachter ..... G03G 15/556 399/27
2007/0058996 A1 * 3/2007 Sakita ..... G03G 15/553 399/27
2007/0200908 A1 * 8/2007 Kin ..... G03G 15/5058 347/140
2008/0131146 A1 * 6/2008 Kendall ..... G03G 15/553 399/27
2012/0027424 A1 * 2/2012 Kawai ..... G03G 15/5079 399/12
2012/0155893 A1 * 6/2012 Hikosaka ..... G03G 15/0824 399/27

* cited by examiner

*Primary Examiner* — David Gray
*Assistant Examiner* — Geoggrey Evans
(74) *Attorney, Agent, or Firm* — Hovey Williams LLP

(57) ABSTRACT

An electronic device for determining a level of toner volume in a replacement toner cartridge used in a printing device comprises a communication element, a memory element, and a processing element. The communication element transmits a request to the printing device to provide data regarding the replacement toner cartridge and receives the data. The data includes a current level of toner volume and a current printed page count. The memory element stores the data received from the printing device. The processing element is in communication with the communication element and the memory element. The processing element is configured to determine one of a plurality of sequential phases of a usage cycle of the replacement toner cartridge corresponding to a value of the current level of toner volume and determine a corrected level of toner volume using one of a plurality of equations selected according to the phase.

20 Claims, 5 Drawing Sheets

SYSTEM AND METHOD FOR DETERMINING A LEVEL OF TONER IN A REPLACEMENT TONER CARTRIDGE

BACKGROUND OF THE INVENTION

1. Field of the Invention

Embodiments of the current invention relate to printing devices and toner cartridges.

2. Description of the Related Art

Printing devices, such as copiers, printers, fax machines, multi-function machines, and the like, typically utilize a toner cartridge to supply the pigment that forms printed text and images on a paper printout. The toner is a dry powder mix that resides in a chamber within the cartridge. In order to alert users to replace the toner cartridge, it is beneficial for the printing device to track the volume or quantity level of toner in the toner cartridge. However, the printing device cannot always detect the level of toner in the toner cartridge. In those cases, it typically can detect how much toner is being used during the print process so that it will have accurate readings for the entire life cycle of the cartridge. The toner cartridge itself may include a sensor system that is able to detect the level of the toner in the cartridge, but only after the level of the toner is below a certain value, such as around 10%. Therefore, the printing device is able to report the level of toner volume in the toner cartridge by estimating the level of toner based on the usage of toner during printing until a predetermined level (controlled by the sensor system) is reached, such as 10%. At this point, the printing device no longer estimates, but relies on the actual level of toner as reported by the toner cartridge. This process provides an accurate reporting of the level of toner by assuming a certain initial volume of toner in the toner cartridge. The initial volume is specified by an original equipment manufacturer (OEM) and is typically the same volume as is included in the original toner cartridge. FIG. 1 shows a plot of toner usage for an original cartridge with an exemplary initial volume that is capable of printing approximately 15,000 pages.

When the toner in the original toner cartridge runs out, a replacement toner cartridge must be installed in the printing device. Often, the replacement toner cartridge is supplied from a third party and may include a greater or smaller initial volume of toner than was in the original cartridge. The printing device may assume that the replacement toner cartridge includes the same volume of toner as was in the original cartridge. This will lead to erroneous reporting of the level of toner in the toner cartridge. FIG. 2 shows a plot of toner usage for an exemplary replacement toner cartridge with a volume capable of printing approximately 19,000 pages. The printing device assumes that the initial volume of the toner cartridge is capable of printing approximately 15,000 pages. FIG. 2 also shows a dashed line indicating the expected usage of toner for the cartridge. The plot shows the level of toner L3 as reported by the printing device. The printing device estimates the level of toner L3 based on usage of the printer until the level of toner L3 is approximately 11%, seen as the diagonal portion of the level of toner L3 from 100% to approximately 11%. At this point, the printing device relies on the toner cartridge to report the level of toner L3. However, because the toner cartridge had a greater initial volume of toner than estimated by the printing device, there is a greater level of toner L3 in the cartridge than the toner cartridge can detect—perhaps 25%-30%, instead of 11%. As a result, the printing device continues to report the level of toner L3 as being 11% until the level of toner L3 is low enough for the toner cartridge to detect. This is seen as a flat, horizontal portion of the level of toner L3 on the plot. Once the level of toner L3 is low enough for the toner cartridge sensor system to detect, the printing device accurately reports the level of toner L3 until the toner is depleted at approximately 19,000 pages, shown as the diagonal portion of the level of toner L3 from approximately 11% to 0%.

The erroneous reporting by the printing device of the level of toner in the toner cartridge can lead to ordering of toner cartridges that are not necessary, especially if usage projections are based on the initial usage of toner. The erroneous reporting may also lead to replacement of toner cartridges that are not yet empty, or possibly to unnecessary service calls.

SUMMARY OF THE INVENTION

Embodiments of the current invention solve the above-mentioned problems and provide a distinct advance in the art of printing devices. More particularly, embodiments of the invention provide an electronic device and computer program that are capable of determining a volume of toner in a toner cartridge that is used in a printing device with greater accuracy.

An embodiment of the electronic device broadly comprises a communication element, a memory element, and a processing element. The communication element transmits a request to the printing device to provide data regarding the replacement toner cartridge and receives the data. The data includes a current level of toner volume and a current printed page count. The memory element stores the data received from the printing device. The processing element is in communication with the communication element and the memory element. The processing element is configured to determine one of a plurality of sequential phases of a usage cycle of the replacement toner cartridge corresponding to a value of the current level of toner volume and determine a corrected level of toner volume using one of a plurality of equations selected according to the phase.

A first phase occurs from an initial usage of the toner cartridge until a point when the current level of toner volume does not change while a predetermined number of pages have been printed. During the first phase, the processing element uses a first equation that adjusts the current level of toner volume to account for a difference between a total volume of toner in an original toner cartridge and a total volume of toner in the replacement toner cartridge. A second phase occurs from the end of the first phase until the current level of toner volume changes. During the second phase, the processing element uses a second equation that subtracts a toner usage value from the current level of toner volume received at the end of the first phase. A third phase occurs from the end of the second phase until the toner in the replacement toner cartridge is depleted. During the third phase, the processing element uses a third equation that equates the corrected level of toner volume to the current level of toner volume.

Embodiments of the computer program include an executable software program stored on a computer-readable medium. The software program may instruct a processing element to perform the following steps: instructing a communication element to transmit a request to the printing device to provide data regarding the replacement toner cartridge and to receive the data, wherein the data includes a current level of toner volume and a current printed page count, instructing a memory element to store data received from the printing device, determining one of a plurality of sequential phases of a usage cycle of the replacement toner cartridge corresponding to a value of the current level of toner volume, and determining a corrected level of toner volume using one of a plurality of equations selected according to the phase.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
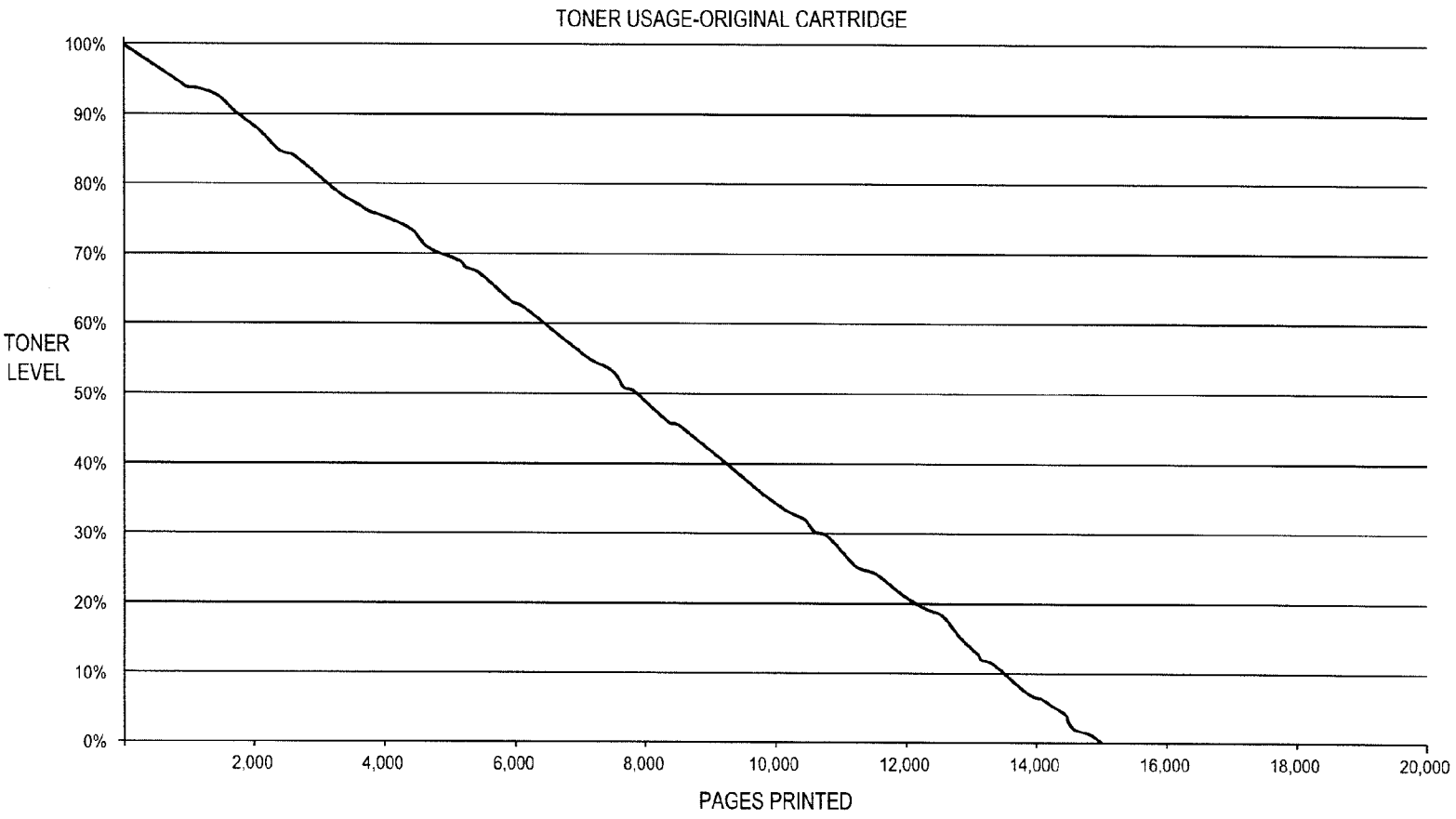
FIG. 1 is a plot of toner level vs. pages printed, depicting toner usage for an original cartridge in a printing device.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Figure 3:
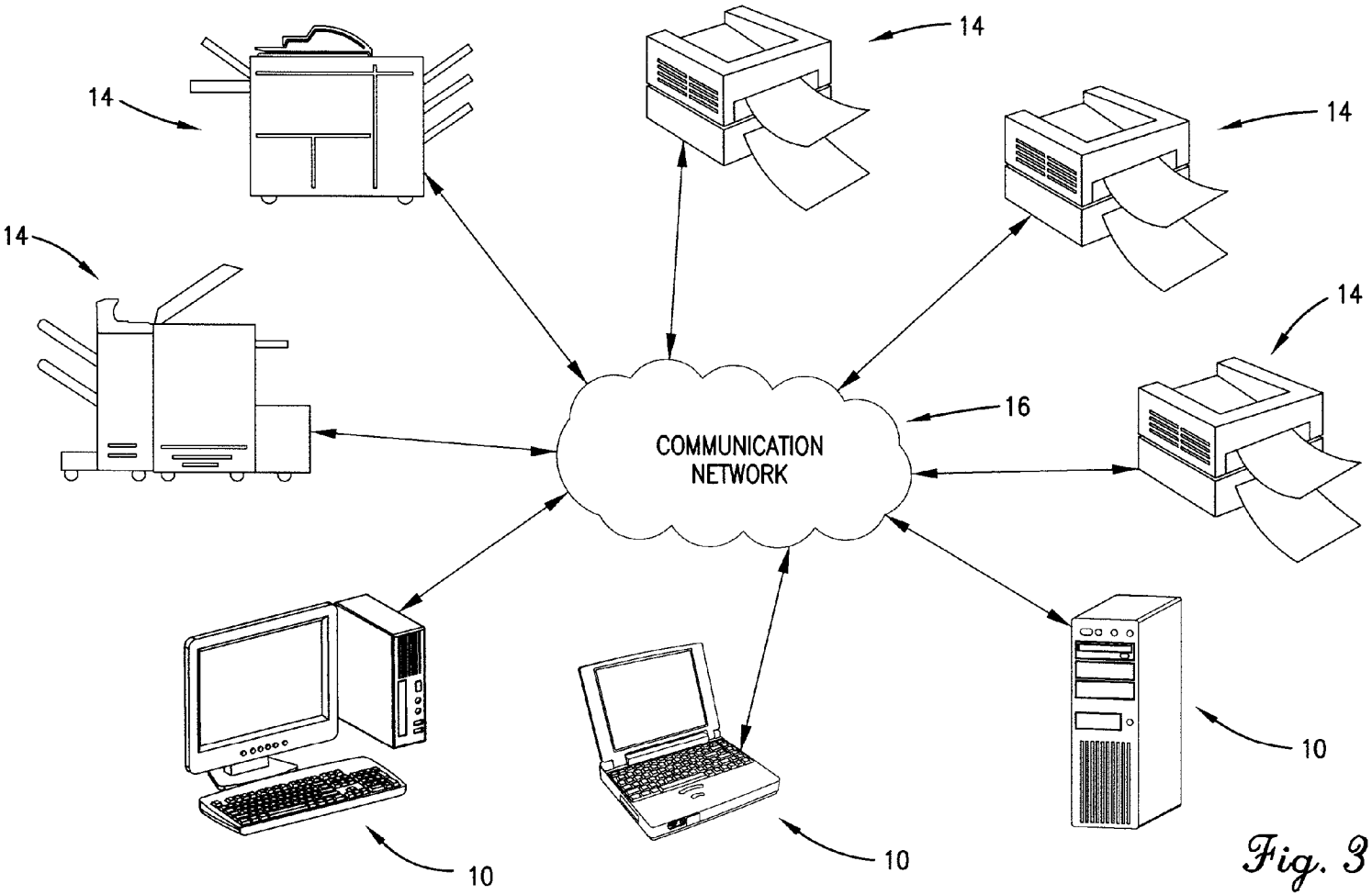
FIG. 3 is a schematic diagram of at least one electronic device, constructed in accordance with various embodiments of the current invention, in communication with at least one printing device.

An electronic device 10, constructed in accordance with various embodiments of the current invention, for monitoring a level of toner volume in a replacement toner cartridge 12 used in a printing device 14 is shown in FIG. 3. The electronic device 10 may communicate with the printing device 14 through a communication network 16.

When an original toner cartridge in the printing device 14 runs out of toner, the cartridge is replaced with a replacement toner cartridge 12 that has often been remanufactured, refurbished, or refilled. Typically, the replacement toner cartridge 12 has been filled with a greater volume of toner than was in the original toner cartridge. The printing device 14 may incorrectly determine, or underestimate, the level of toner volume in the replacement toner cartridge 12, leading to replacement or refilling of the replacement toner cartridge 12 before it is empty. The electronic device 10 may include hardware, software, firmware, or combinations thereof that can more accurately determine the level of the toner volume so that the replacement toner cartridge 12 may be fully utilized.

Figure 4:
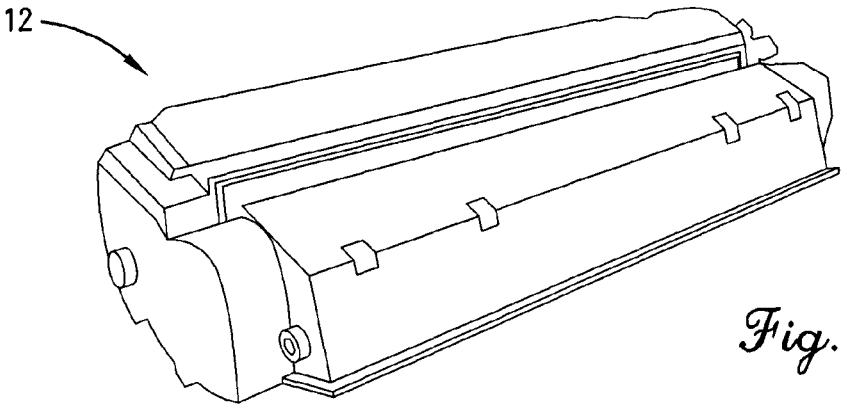
FIG. 4 is a perspective view of a toner cartridge.

The replacement toner cartridge 12, shown in FIG. 4, generally provides the toner for the printing device 14. The toner may be a dry powder form of fine granule pigment and binder particles, wherein the pigment provides the color and the binder, when heated, makes the pigment stick to a sheet of paper. In some embodiments, the replacement toner cartridge 12 may include a housing that houses at least a hopper to store the toner, an agitator to dispense the toner, and a sensor to determine the volume or quantity level of the toner. The sensor may only detect or activate when the level of the toner is less than a predetermined volume. In other embodiments, the replacement toner cartridge 12 may additionally include components such as a photosensitive drum, a developer roller, a static charge roller, wiper blades, and the like to carry out the laser printing process.

The replacement toner cartridge 12 may be supplied by an original equipment manufacturer (OEM) or by a third party supplier. The replacement toner cartridge 12 may be original stock, remanufactured, refurbished, or refilled. As a result of these variations of sources of the replacement toner cartridge 12, each replacement toner cartridge 12 may have a varying total volume of toner. Typically, the volume of toner is indicated, such as by a part number, a barcode or structural features on the housing of the replacement toner cartridge 12.

Figure 5:
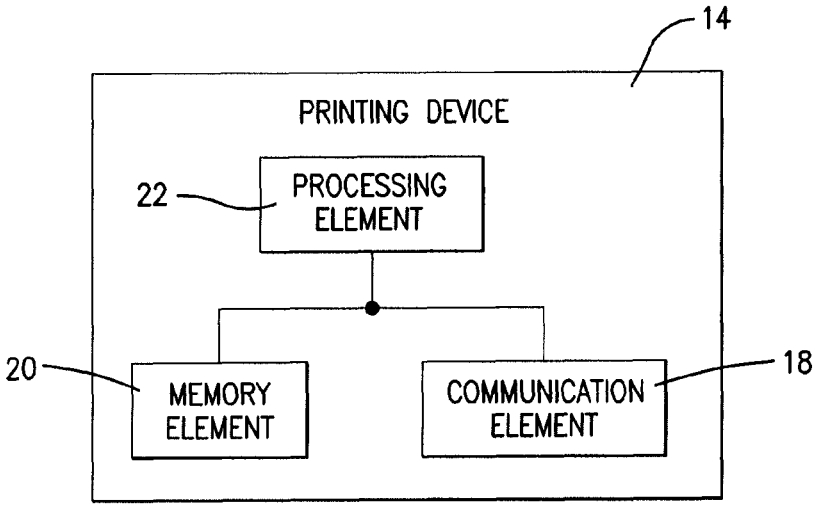
FIG. 5 is a schematic block diagram of some components of the printing device.

The printing device 14, as indicated in FIG. 3, may be embodied by printers such as laser printers, copiers, copy machines, photocopiers, multi-function copiers, and other devices that utilize the replacement toner cartridge 12. The printing device 14 may receive commands from one or more electronic devices 10 to print word processing documents, spreadsheets, website documents, photographs, images, and the like. In some embodiments, the printing device 14 may receive instructions from a user through an interface panel to copy documents and graphics by scanning and printing. The printing device 14 may include one or more paper sources such as trays or feed ports, may utilize one or more toner cartridges in combination with one or more laser printing assemblies, and may include one or more sensors, such optical sensors or the like, or a software algorithm which can estimate the dots or pixels on a printed page and determine toner usage. The printing device 14, as shown in FIG. 5, may also include a communication element 18, a memory element 20, and a processing element 22.

The communication element 18 generally allows communication with external systems or devices. The communication element 18 may include signal or data transmitting and receiving circuits, such as antennas, amplifiers, filters, mixers, oscillators, digital signal processors (DSPs), and the like. The communication element 18 may establish communication wirelessly by utilizing radio frequency (RF) signals and/or data that comply with communication standards such as cellular 2G, 3G, or 4G, Institute of Electrical and Electronics Engineers (IEEE) 802.11 standard such as WiFi, IEEE 802.16 standard such as WiMAX, Bluetooth™, or combinations thereof. Alternatively, or in addition, the communication element 18 may establish communication through connectors or couplers that receive metal conductor wires or cables which are compatible with technologies such as ethernet. The communication element 18 may also couple with optical fiber cables. The communication element 18 may be in communication with the processing element 22 and the memory element 20.

The memory element 20 may include data storage components such as read-only memory (ROM), programmable ROM, erasable programmable ROM, random-access memory (RAM) such as static RAM (SRAM) or dynamic RAM (DRAM), hard disks, floppy disks, optical disks, flash memory, thumb drives, universal serial bus (USB) drives, or the like, or combinations thereof. The memory element 20 may include, or may constitute, a "computer-readable medium". The memory element 20 may store the instructions, code, code segments, software, firmware, programs, applications, apps, services, daemons, or the like that are executed by the processing element 22. The memory element 20 may also store settings, data, documents, sound files, photographs, movies, images, databases, and the like.

The processing element 22 may include processors, microprocessors, microcontrollers, digital signal processors (DSPs), field-programmable gate arrays (FPGAs), analog and/or digital application-specific integrated circuits (ASICs), or the like, or combinations thereof. The processing element 22 may generally execute, process, or run instructions, code, code segments, software, firmware, programs, applications, apps, processes, services, daemons, or the like. The processing element 22 may also include hardware components such as finite-state machines, sequential and combinational logic, and other electronic circuits that can perform control or other functions necessary for the operation of the current invention. The processing element 22 may be in communication with the other electronic components through serial or parallel links that include address busses, data busses, control lines, and the like.

During usage of the printing device 14, the communication element 18 may receive commands and data to print documents. The processing element 22 in combination with the memory element 20 may control the operation of the printing device 14, including the operation of paper feeding mechanisms, the laser printing assembly, and the replacement toner cartridge 12. The processing element 22 may also track printing performance and replacement toner cartridge 12 usage data and store the data in the memory element 20. The data may include an initial level of the toner volume (stored as L1) reported as a percentage of the total volume, an initial printed page count (C1), a current level of the toner volume (L3) reported as a percentage of the total volume, and a current printed page count (C3). The initial values refer to the value when the current toner cartridge 12 was first installed. The current level of the toner volume may be determined by the processing element 22 based on input from the sensors. The processing element 22 may determine or estimate the level of toner until the level reaches approximately 10%. At that point, the printing device 14 relies on the level of toner volume as indicated by the replacement toner cartridge 12 itself. The memory element 20 may also store the total volume (V1) of toner from the original manufacturer, as well as the total volume (V2) of toner for the current toner cartridge 12. The volume may be reported as a quantity, such as a weight or mass (in kilograms, for example), or as a number of expected or average pages of printed paper. As mentioned above, the volume V2 of the replacement toner cartridge 12 is usually greater than the volume V1 of the original toner cartridge.

The communication network 16, as seen in FIG. 3, generally allows communication between the electronic devices 10 and the printing devices 14. The communication network 16 may include local area networks, metro area networks, wide area networks, cloud networks, the Internet, and the like, or combinations thereof. The communication network 16 may be wired, wireless, or combinations thereof and may include components such as switches, routers, hubs, access points, and the like. The electronic devices 10 may connect to the communication network 16 either through wires, such as ethernet-compatible cables or fiber optic cables, or wirelessly, such as radio frequency (RF) communication using wireless standards such as Bluetooth® or the Institute of Electrical and Electronic Engineers (IEEE) 802.11.

Figure 6:
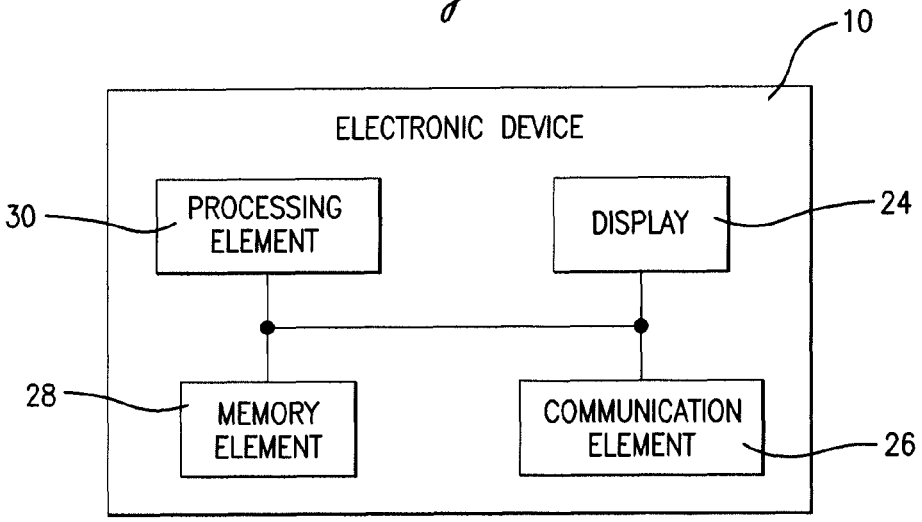
FIG. 6 is a schematic block diagram of some components of the electronic device.

The electronic device 10, as indicated in FIG. 3, may be embodied by various types of computing devices such as desktop computers, workstation computers, laptop computers, tablet computers, server computers, and the like, as well as handheld devices such as smart phones. The electronic device 10, shown in FIG. 6, may broadly comprise a display 24, a communication element 26, a memory element 28, and a processing element 30. The communication element 26, the memory element 28, and the processing element 30 may each be similar in structure to the respective communication element 18, memory element 20, and processing element 22 discussed above.

The display 24 may include video devices of the following types: plasma, light-emitting diode (LED), organic LED (OLED), Light Emitting Polymer (LEP) or Polymer LED (PLED), liquid crystal display (LCD), thin film transistor (TFT) LCD, LED side-lit or back-lit LCD, heads-up displays (HUDs), or the like, or combinations thereof. The display 24 may possess a square or a rectangular aspect ratio and may be viewed in either a landscape or a portrait mode. In some embodiments, the display 24 may be a separate unit from the other components of the electronic device 10, while in other embodiments, the display 24 may be integrated with the other components of the electronic device 10. In various embodiments, the display 24 may also include a touch screen occupying the entire screen or a portion thereof so that the display 24 functions as part of a user interface. The touch screen may allow the user to interact with the electronic device 10 by physically touching, swiping, or gesturing on areas of the screen.

The processing element 30 may be programmed or configured to communicate with at least one printing device 14 to retrieve the printing and toner cartridge data. The processing element 30 may instruct, direct, or command the communication element 26 to transmit a request for information from the printing device 14. The requested data may be received from the printing device 14 through the communication element 26. The retrieval may occur at regular time intervals, such as every five minutes. The received data may be stored in the memory element 28, as instructed by the processing element 30. The data may include the following quantities: V1, V2, L1, C1, L3, and C3, as discussed above. From this data, the processing element 30 may track and store the following quantities: L2, which is the last reported level of toner volume and is updated when L3 changes, and C2, which is the last reported printed page count and is updated when L2 changes.

Figure 7:
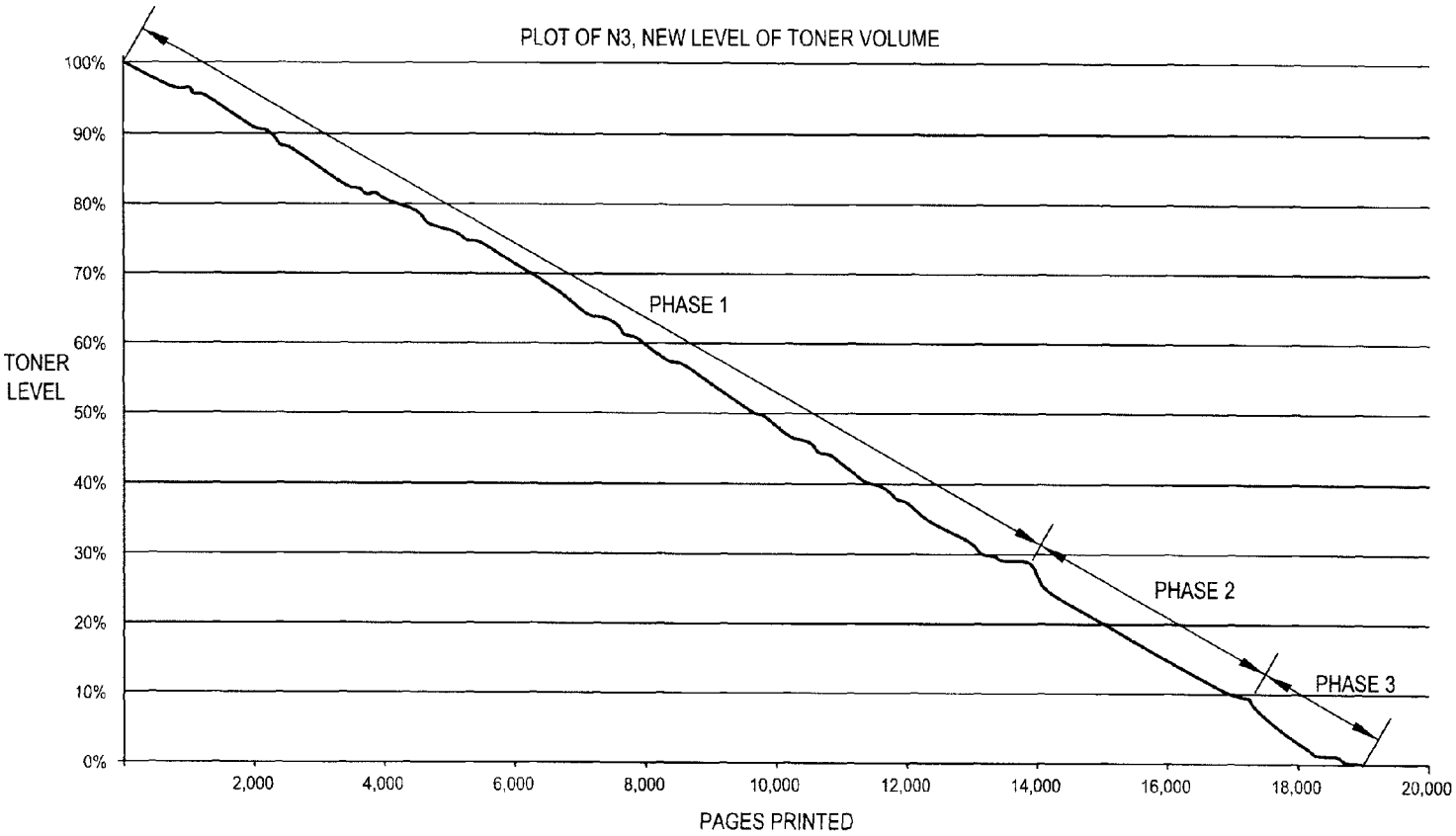
FIG. 7 is a plot of toner level vs. pages printed, depicting a more accurate determination of toner usage for the replacement cartridge in the printing device.

The processing element 30 may determine a corrected, more accurate level of the toner volume (N3, determined as a percentage). The method used to determine the corrected level of toner volume, N3, depends on a phase of the usage cycle of the current toner cartridge 12. The processing element 30 also may determine the phase of the usage cycle of the current toner cartridge 12, based on the data from the printing device 14, as one of the following three phases: phase 1, which applies when the replacement toner cartridge 12 is first installed until the printing device 14 is repeatedly reporting a constant level of toner volume, L3, phase 2, which applies until the level of the toner volume, L3, reported by the printing device 14 changes, and phase 3, which applies until the toner in the replacement toner cartridge 12 is depleted. FIG. 7 shows a plot of N3 for an exemplary replacement toner cartridge 12 that has a toner volume capable of printing approximately 19,000 pages. The three phases are also labeled in FIG. 7.

Figure 2:
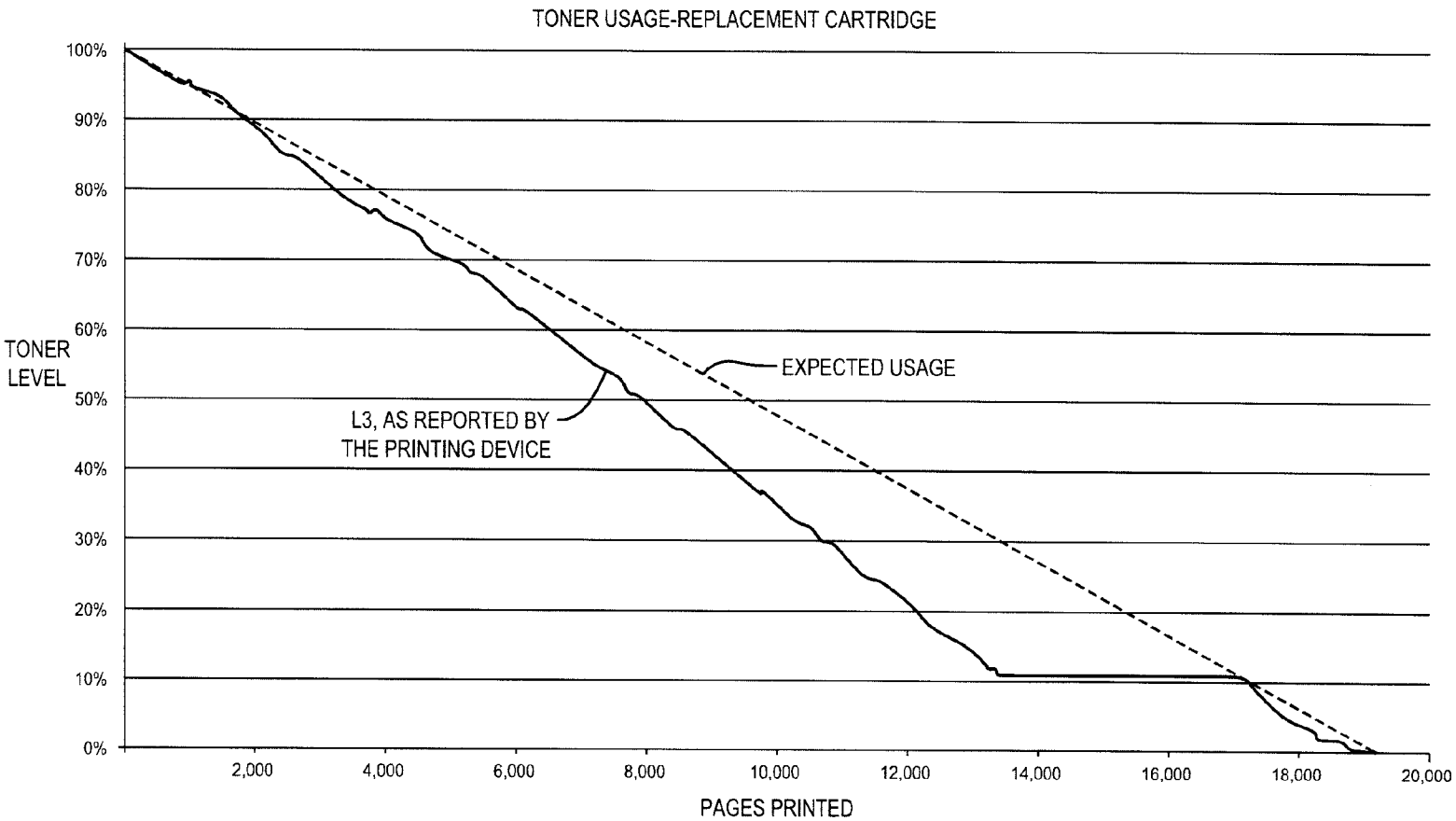
Fig. 2. PRIOR ART
FIG. 2 is a plot of prior art toner level vs. pages printed, depicting toner usage for a replacement cartridge in the printing device.

During phase 1, the processing element 30 assumes that the level of toner volume, L3, reported by the printing device 14 is relatively accurate, but just needs to be adjusted to account for the difference in total volume of toner between the original toner cartridge, V1, and the replacement toner cartridge 12, V2. The adjustment may be accomplished by determining the usage of toner, scaling the usage by a ratio of the original toner volume to the replacement toner volume, and subtracting the result from 1 to determine the corrected level. The processing element 30 utilizes the values of L3 as seen in the relatively straight, angled line portion between 100% and approximately 11% on the plot in FIG. 2. An equation to determine the corrected level of toner volume N3, employing the adjustment based on L3, V1, and V2, is shown below in EQ. 1.

$$N3 = 1 - (1 - L3)\frac{V1}{V2} \qquad \text{EQ. 1}$$

Typically, the level of toner volume, L3, reported from the printing device 14 is reported as a percentage such that the range of L3 is 0% to 100%. Given the estimated total number of pages that the replacement toner cartridge 12 can print, an average toner usage rate, or an average number of pages per percentage of toner volume, may be determined by dividing the total page number by 100%. With an exemplary replacement toner cartridge 12 that can print approximately 19,000 pages (assuming a toner coverage rate per page of 5%), the average number of pages printed for each percentage value of L3 is approximately 190. In other words, on average, the level of toner volume, L3, would decrease by 1% for every 190 pages of paper that are printed. Alternatively, the average toner usage rate may be determined by dividing 100% by the total number of pages. Continuing the example (using 100%/19,000), the average amount of toner used per page is approximately 0.005%.

It is generally known that, because the replacement toner cartridge 12 includes a greater volume of toner than the original toner cartridge, the printing device 14 erroneously reports the level of toner volume, L3, once the printing device 14 starts relying on the level reported from the replacement toner cartridge 12 at approximately 11%, for example. Thus, the printing device 14 may continue to report that the level of toner volume, L3, is 11% even though a greater number of pages have been printed than the number of pages per percentage of toner volume. This can be seen as the flat, horizontal line portion of the plot of L3 in FIG. 2. The continuous reporting of the same level of toner, L3, is an indication that phase 2 has begun. The processing element 30 may track the number of pages that have been printed since the last change of the percentage value of the level of the toner volume, L3. If the number of pages exceeds a predetermined value, then the processing element 30 may determine the switch to phase 2. The value of the number of pages may be related to a certain percentage, such as 3%, of toner that would be used to print a large number of pages. The value may be determined by multiplying the percentage by the average toner usage rate mentioned above (which may be an average toner usage rate for a large number of toner cartridges). Alternatively, the value may be determined by multiplying the percentage by the recent toner usage rate for the current toner cartridge 12, which is indicated by the relationship shown in EQ. 2.

$$\frac{\text{Pages_Printed}}{\text{Toner_Used}} = \frac{C2 - C1}{L1 - L2} \qquad \text{EQ. 2}$$

Wherein L2 and C2 are values tracked by the processing element 30, as mentioned above. Therefore, an exemplary number of pages that has to be printed at the same percentage value of the level of the toner volume, L3, before the processing element 30 determines that phase 2 has begun may be: 3%×(C2 −C1)/(L2 −L1).

During phase 2, the processing element 30 corrects for the fact that the printing device 14 is no longer reporting a change in the percentage value of the level of the toner volume, L3, even though enough pages have been printed such that L3 should have changed. The corrected level of toner volume, N3, may be determined by calculating the level of toner volume that was left at the end of phase 1 (calculated by using EQ. 1 above) and then subtracting the amount of toner that has been used since that point (which can be found by multiplying the toner usage rate established during phase 1 by the number of pages that have been printed so far in phase 2). The determination of N3 is shown below in EQ. 3.

$$N3 = \left[1 - (1 - L2)\frac{V1}{V2}\right] - \left[\left(\frac{L1 - L2}{C2 - C1}\right) \times (C3 - C2)\right] \qquad \text{EQ. 3}$$

Wherein C3 is the current printed page count, as mentioned above. The processing element 30 may continue to determine the corrected level of toner volume, N3, using EQ. 3—all the while checking for a change in the level of the toner volume, L3, reported from the printing device 14. Once the level of the toner volume, L3, changes, then the processing element 30 determines that phase 3 has begun.

During phase 3, the processing element 30 assumes that the level of the toner volume, L3, reported from a sensor in the replacement toner cartridge 12 of the printing device 14 is correct. Thus, for phase 3, which lasts until the toner in the replacement toner cartridge 12 is depleted or the cartridge 12 is removed from the device, the corrected level of toner volume, N3, is the same as the level of the toner volume, L3, as shown in EQ. 4.

$$N3 = L3 \qquad \text{EQ. 4}$$

The processing element 30 may communicate the corrected level of toner volume, N3, to the display 24 in a periodically updated fashion so that a user may monitor the corrected level of toner volume. The processing element 30 may also generate an alert or a notification, such as through email, to the user regarding the corrected level of toner volume, N3. The alert may let the user know that an action with reference to the replacement toner cartridge 12 is required. In addition, the processing element 30 may generate an alert or a notification to an automatic supply replenishment system which may order a new replacement toner cartridge 12. This may occur when the corrected level of toner volume, N3, falls below a certain value, such as 5% or the level of toner is sufficient to only print for five more days.

The actions taken by the processing element 30 discussed above may be controlled by hardware components, such as electronic circuitry, by software, such as an executable program, or by a combination of both.

The electronic device 10 may query a single printing device 14 or a plurality of printing devices 14 and determine an accurate level of the toner in each replacement toner cartridge 12 for each printing device 14 in the manner discussed above. In some scenarios, the printing devices 14 may include all of the printing devices 14 that are utilized in a home, in an office, in a building, on a campus, or the like. In some situations, the electronic device 10 may be positioned in the same location as the printing devices 14, while in other situations, the electronic device 10 may be positioned in a different location. Although embodiments of the current invention are optimized for use when the replacement toner cartridge has a greater initial volume of toner than did the original toner cartridge, the current invention functions just as well when the volume of toner in the replacement toner cartridge is the same as or less than the volume of toner in the original toner cartridge.

Embodiments of the current invention provide significantly more than the application of an abstract idea using a generic computer. The current invention provides improvements to the field of printing devices in general and tracking a level of toner in a toner cartridge in particular. Prior art approaches failed to accurately track the toner level in a replacement toner cartridge with a greater initial volume of toner than was included in the original toner cartridge. The current invention is able to use the erroneous data regarding the toner level and generate corrected data that more accurately reflects the level of toner in a replacement toner cartridge.

Embodiments of the current invention may include an electronic device with a communication element, a memory element, and a processing element. The communication element may allow communication between the electronic device and external systems or devices. The memory element may store programs, applications, or instructions for the processing element to execute. The processing element may be programmed, utilizing programs in the memory element to perform selected functions. Specifically, the processing element of the current invention is programmed to correct erroneous data regarding the level of toner in a replacement toner cartridge.

In addition, the electronic device is necessary to perform the calculations needed to correct the data from each printing device. It would require too much time for a human to perform, especially when a large number of printing devices are involved. Furthermore, data may be received from printing devices at times when humans are not able or willing to work.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. An electronic device for determining a level of toner volume in a replacement toner cartridge used in a printing device, the electronic device comprising:

a communication element for transmitting a request to the printing device to provide data regarding the replacement toner cartridge and for receiving the data, wherein the data includes a current level of toner volume, a current printed page count, an original cartridge total toner volume, and a replacement cartridge total toner volume;

a memory element for storing data received from the printing device; and a processing element in communication with the communication element and the memory element, the processing element configured to— determine one of a plurality of sequential phases of a usage cycle of the replacement toner cartridge corresponding to a value of the current level of toner volume, and determine a corrected level of toner volume using one of a plurality of equations selected according to the phase, wherein the processing element determines the corrected level of toner volume at least partially based on a ratio of the original cartridge total toner volume to the replacement cartridge total toner volume.

2. The electronic device of claim 1, wherein the processing element is further configured to transmit an alert to a toner cartridge replenishment system when the corrected level of toner volume is less than a first value.

3. The electronic device of claim 1, wherein the processing element is further configured to— determine a first phase as existing from an initial usage of the toner cartridge until a point when the current level of toner volume does not change while a predetermined number of pages have been printed, determine a second phase as existing from the end of the first phase until the current level of toner volume changes, and determine a third phase as existing from the end of the second phase until the toner in the replacement toner cartridge is depleted.

4. The electronic device of claim 3, wherein the predetermined number of pages is determined by multiplying a first value of toner volume by a calculated rate of toner usage.

5. The electronic device of claim 4, wherein the rate of toner usage is determined by dividing a number of pages printed by the current replacement toner cartridge by a volume of toner used by the current replacement toner cartridge.

6. The electronic device of claim 3, wherein the processing element is further configured to— determine the corrected level of toner volume during the first phase by utilizing a first equation that adjusts the current level of toner volume to account for a difference between a total volume of toner in an original toner cartridge and a total volume of toner in the replacement toner cartridge, determine the corrected level of toner volume during the second phase by utilizing a second equation that subtracts a toner usage value from the current level of toner volume received at the end of the first phase, and determine the corrected level of toner volume during the third phase by utilizing a third equation that equates the corrected level of toner volume to the current level of toner volume.

7. The electronic device of claim 6, wherein the first equation adjusts the current level of toner volume by determining a first volume of toner that has been used when the current level of toner volume is received, scaling the first volume by a ratio of the original toner cartridge total volume to the replacement toner cartridge total volume, and subtracting the scaled value from 1.

8. The electronic device of claim 6, wherein the toner usage value of the second equation is determined by multiplying a toner usage rate by a number of pages printed since the end of the first phase.

9. The electronic device of claim 8, wherein the toner usage rate is determined by dividing a difference between the initial level of toner volume and the current level of toner volume by a difference between the current printed page count and the initial printed page count.

10. A non-transitory computer-readable storage medium with an executable program stored thereon for determining a level of toner volume in a replacement toner cartridge used in a printing device, wherein the program instructs a processing element to perform the following steps:

instructing a communication element to transmit a request to the printing device to provide data regarding the replacement toner cartridge and to receive the data, wherein the data includes a current level of toner volume, a current printed page count, an original cartridge total toner volume, and a replacement cartridge total toner volume;

instructing a memory element to store data received from the printing device;

determining one of a plurality of sequential phases of a usage cycle of the replacement toner cartridge corresponding to a value of the current level of toner volume; and determining a corrected level of toner volume using one of a plurality of equations selected according to the phase, wherein the corrected level of toner volume depends in part on a ratio of the original cartridge total toner volume to the replacement cartridge total toner volume.

11. The non-transitory computer-readable storage medium of claim 10, wherein the program further instructs the processing element to transmit an alert to a toner cartridge replenishment system when the corrected level of toner volume is less than a first value.

12. The non-transitory computer-readable storage medium of claim 10, wherein the program further instructs the processing element to— determine a first phase as existing from an initial usage of the toner cartridge until a point when the current level of toner volume does not change while a predetermined number of pages have been printed, determine a second phase as existing from the end of the first phase until the current level of toner volume changes, and determine a third phase as existing from the end of the second phase until the toner in the replacement toner cartridge is depleted.

13. The non-transitory computer-readable storage medium of claim 12, wherein the predetermined number of pages is determined by multiplying a first value of toner volume by a calculated rate of toner usage.

14. The non-transitory computer-readable storage medium of claim 13, wherein the rate of toner usage is determined by dividing a number of pages printed by the current replacement toner cartridge by a volume of toner used by the current replacement toner cartridge.

15. The non-transitory computer-readable storage medium of claim 12, wherein the program further instructs the processing element to— determine the corrected level of toner volume during the first phase by utilizing a first equation that adjusts the current level of toner volume to account for a difference between a total volume of toner in an original toner cartridge and a total volume of toner in the replacement toner cartridge, determine the corrected level of toner volume during the second phase by utilizing a second equation that subtracts a toner usage value from the current level of toner volume received at the end of the first phase, and determine the corrected level of toner volume during the third phase by utilizing a third equation that equates the corrected level of toner volume to the current level of toner volume.

16. The non-transitory computer-readable storage medium of claim 15, wherein the first equation adjusts the current level of toner volume by determining a first volume of toner that has been used when the current level of toner volume is received, scaling the first volume by a ratio of the original toner cartridge total volume to the replacement toner cartridge total volume, and subtracting the scaled value from 1.

17. The non-transitory computer-readable storage medium of claim 15, wherein the toner usage value of the second equation is determined by multiplying a toner usage rate by a number of pages printed since the end of the first phase.

18. The non-transitory computer-readable storage medium of claim 17, wherein the toner usage rate is determined by dividing a difference between the initial level of toner volume and the current level of toner volume by a difference between the current printed page count and the initial printed page count.

19. An electronic device for determining a level of toner volume in a replacement toner cartridge used in a printing device, the electronic device comprising:

a communication element for transmitting a request to the printing device to provide data regarding the replacement toner cartridge and for receiving the data, wherein the data includes a current level of toner volume and a current printed page count;

a memory element for storing data received from the printing device; and a processing element in communication with the communication element and the memory element, the processing element configured to— determine a first phase as existing from an initial usage of the toner cartridge until a point when the current level of toner volume does not change while a predetermined number of pages have been printed, determine a corrected level of toner volume during the first phase by utilizing a first equation that adjusts the current level of toner volume to account for a difference between a total volume of toner in an original toner cartridge and a total volume of toner in the replacement toner cartridge, determine a second phase as existing from the end of the first phase until the current level of toner volume changes, determine the corrected level of toner volume during the second phase by utilizing a second equation that subtracts a toner usage value from the current level of toner volume received at the end of the first phase, determine a third phase as existing from the end of the second phase until the toner in the replacement toner cartridge is depleted, determine the corrected level of toner volume during the third phase by utilizing a third equation that equates the corrected level of toner volume to the current level of toner volume, and transmit an alert to a toner cartridge replenishment system when the corrected level of toner volume is less than a first value.

20. The electronic device of claim 19, wherein the current level of toner volume is defined as a percentage of the total volume of toner in the original toner cartridge and the corrected level of toner volume is defined as a percentage of the total volume of toner in the replacement toner cartridge.

* * * * *